US005258731A

United States Patent [19]

Zemke

[11] Patent Number: 5,258,731

[45] Date of Patent: Nov. 2, 1993

[54] COAXIAL REVERSE POWER PROTECTION RELAY

[75] Inventor: Steven C. Zemke, Post Falls, Id.

[73] Assignee: Hewlett-Packard Company, Palo Alto, Calif.

[21] Appl. No.: 962,376

[22] Filed: Oct. 15, 1992

[51] Int. Cl.[5] ..... H01H 53/00

[52] U.S. Cl. ..... 335/4; 335/151

[58] Field of Search ..... 335/4, 5, 104, 105, 335/151, 152, 153, 154

[56] References Cited

U.S. PATENT DOCUMENTS

| | | | |
|---|---|---|---|
| 3,575,678 | 4/1971 | Barton | 335/151 |
| 3,928,829 | 12/1975 | Abrams | 335/151 |
| 4,232,281 | 11/1980 | Smith | 335/152 |
| 4,870,385 | 9/1989 | Jewell | 335/5 |

*Primary Examiner*—Lincoln Donovan

[57] ABSTRACT

A coaxial reverse power protection relay using a conductive elastomeric tube and a conductive body. The relay includes a reed switch enclosed within the central channel of the conductive body. The tube concentrically surrounds the reed switch within the channel. The tube retains the reed switch in place and serves as a conformal ground. A magnetic coil is wound around a portion of the body. When energized the coil produces a magnetic field which closes the reed switch. When de-energized, the coil's magnetic field ceases, opening the reed switch. The reed switch, along with center contacts form a center conductor within the channel of the relay body. The body and elastomeric tube form an outer conductor. The relay is impedance matched to RF connector and instrument transmission line impedances. A nonuniform impedance occurring along the length of the reed switch is balanced by the conforming tube walls. The internal wall of the conductive body has a retention thread in the vicinity of the reed switch. Such threading holds the tubing in place during installation.

13 Claims, 3 Drawing Sheets

COAXIAL REVERSE POWER PROTECTION RELAY

BACKGROUND OF THE INVENTION

This invention relates to devices for protecting RF instruments from damage due to injection of high power surges. More particularly, this invention relates to a coaxial relay adjoining an RF instrument connector for protecting an RF instrument from reverse power surges.

RF instruments such as signal generators, spectrum analyzers, network analyzers and measuring receivers may be exposed to high power surges of 50 Watts or more inadvertently injected into an external signal port. Such instruments have sensitive internal circuitry which would be damaged upon exposure to such reverse power surges. Accordingly, there has been a need to protect the internal circuitry, isolating the circuits from reverse power surges.

Typically, limiting diodes are placed in-line to an output connector enabling output current to flow, while clamping the voltage level on any injected reverse power surge signals. In practice, however, the size of the diodes is limited so as to maintain matched impedance along the signal path. It is well known that impedance matching is needed along RF instrument signal paths to minimize signal reflection and resulting degradations over the operating frequency range. As a result, the limited diode size enables the diodes to protect against high power surges for only a short period of time. Thereafter the diodes fail and no longer serve to limit the voltage.

To adequately protect the internal circuitry of an RF instrument, a relay is used between the connector and the limiting diodes. Normally, the relay is closed allowing signals to flow in either direction. Thus, an output signal can flow in one direction and an injected signal can flow back along the signal path into the instrument in the opposite direction. In response to a reverse power injection above a specified threshold, the relay is triggered open. Creating the open circuit saves the limiting diodes and internal circuitry from damage.

The limiting diodes provide an interim time period for protecting the internal circuitry while the reverse power surge is detected and the relay is switched open. By switching the relay open, the internal circuitry is isolated from the injected power surge. Like the diodes, the relay also must provide good impedance matching capabilities to avoid signal reflection and related signal degradation during normal operation.

One type of relay used for reverse power protection is a coaxial relay. U.S. Pat. No. 4,870,385 (Jewell) discloses a coaxial relay switch for RF signals. An embodiment of the switch 10 as shown in FIG. 1 includes an electrically insulating body 12 having a central channel receiving a reed switch 14. Reed switches are used for applications where RF signals are to be switched on or off in a very short time period. A reed switch typically includes ferromagnetic contacts hermetically sealed in a glass vial. In the presence of a specified magnetic field the contacts are drawn together closing the signal path. In the absence of the magnetic field the contacts are relaxed out of physical communication opening the signal path. The reed switch contacts extend out of the glass enclosure within the channel 13 of body 12. A portion of the exposed contact is surrounded by an insulator 16 which abuts the glass enclosure. Toward a distal end of the contact, a center contact receives the reed switch contact. The center contact establishes coupling to an RF connector 18.

To achieve impedance matching in the embodiment described in U.S. Pat. No. 4,870,385, an electrically conductive resin is injected into the body 12 in the space between the body 12 and the glass enclosure 14, and in the space between the body 12 and a portion of the insulators 16. The resin is an electrically conductive epoxy resin, which upon curing, becomes mechanically rigid integrating the switch 14, insulators 16 and RF connectors 18. The cured resin provides a conformal outer conductor surrounding the switch assembly so as to eliminate impedance mismatching along the length of the glass enclosure. A problem with such a relay, and in particular with the use of a resin, is the typically low yield during manufacturing, the susceptibility to RF radiation, and the fragility of the finished assembly.

In creating a conductive epoxy resin, conductive material is integrated with the resin and frozen to a very low temperature for storage. Special chemicals for maintaining the sub-zero temperatures and special transportation to the parts manufacturer are required. The parts manufacturer receives the resin in the frozen state, thaws it, injects it into relay during assembly, then cures it into a rigid state. Once thawed, the resin typically has only a 1–2 hour shelf life within which it must be injected and cured. Curing is done by baking the component. In practice, there are many manufacturing constraints when using the resin which result in yields as low as 10%. In addition, the special handling of the resin causes the price to be relatively high. Low yields result in wasted material and extra cost. Accordingly there is a need for a relay having improved manufacturing yield characteristics.

Another problem with the resin is the difficulty in achieving a highly conductive state. While being conductive, the conductivity is not always high enough to avoid susceptibility to induced current on the center conductor in the presence of surrounding high frequency RF radiation. In practice, maintaining 70 dBc isolation or more has been difficult. To reduce susceptibility it is desirable to have an improved relay.

SUMMARY OF THE INVENTION

According to the invention, an improved coaxial reverse power protection relay is achieved in which a conductive elastomeric tube and conductive body provide specific functions of the resin. The tube both retains the reed switch in place and serves as a conformal ground. The body serves as the outer conductor greatly reducing susceptibility to external RF radiation. The improved relay includes a reed switch enclosed within the central channel of a conductive body. The tube concentrically surrounds the reed switch within the channel. A magnetic coil is wound around a portion of the body. When energized the coil produces a magnetic field which closes the reed switch. When de-energized, the coil's magnetic field ceases, opening the reed switch. The relay also includes standard RF connectors at alternate ends of the body.

The reed switch, along with center contacts form a center conductor within the channel of the relay body. The body and elastomeric tube form an outer conductor. Insulators and the reed switch enclosure form insulating dielectrics between the outer and center conductors. Together the structure defines a transmission line.

According to one aspect of the invention, the relay is impedance matched to RF connector and instrument transmission line impedances (i.e., 50 ohms). In particular, a nonuniform impedance occurring along the length of the reed switch is balanced by the conforming tube walls. The tube walls vary in thickness along the length of the switch conforming to the reed switch enclosure shape and conforming to the inner body walls (i.e., channel).

According to another aspect of the invention, the outer body is conductive enabling the relay to substantially eliminate susceptibility to RF radiation to the same extent as an SMA connector.

According to another aspect of the invention, the internal wall of the conductive body has a retention thread (i.e., multiple ridges) in the vicinity of the reed switch. Such threading holds the tubing in place during installation.

According to another aspect of the invention, the dielectric insulators have recessed areas adjacent to the reed switch for receiving ends of the reed switch enclosure. By surrounding the reed switch with the elastomeric tube and fitting the enclosure ends into the insulator recessed areas, a tight fit is established which provides the benefits of an integral structure. The insulator recessed area defines the end point of the elastomeric tube.

These and other aspects of the invention result in a coaxial reverse power protection RF relay having a greatly simplified manufacturing process, improved manufacturing yields and substantially reduced susceptibility to RF fields. The invention will be better understood by reference to the following detailed description taken in conjunction with the accompanying drawings.

DESCRIPTION OF SPECIFIC EMBODIMENTS

Overview

Figure 1:
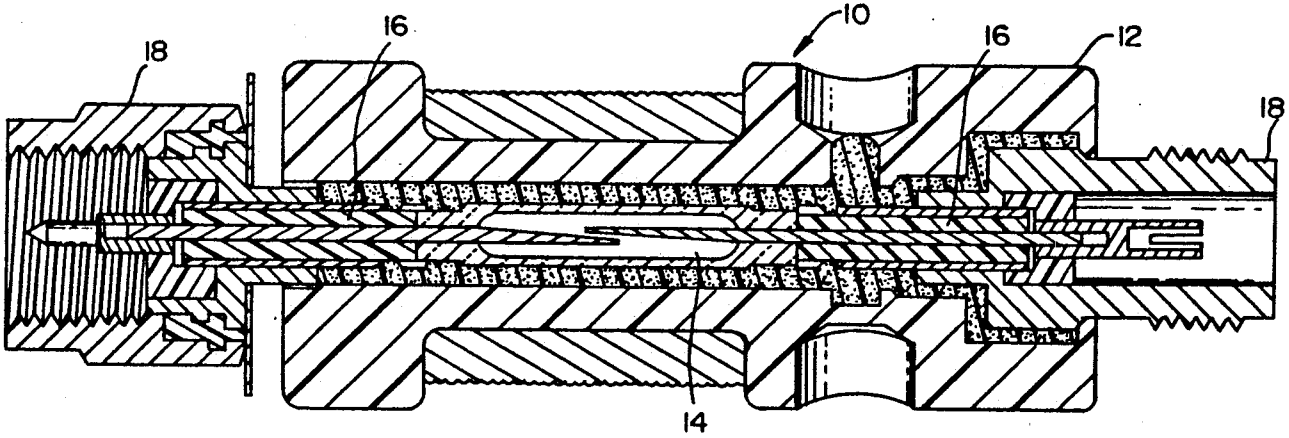
FIG. 1 PRIOR ART
FIG. 1 is a cut-away view of a prior art coaxial RF relay.
Figure 2:
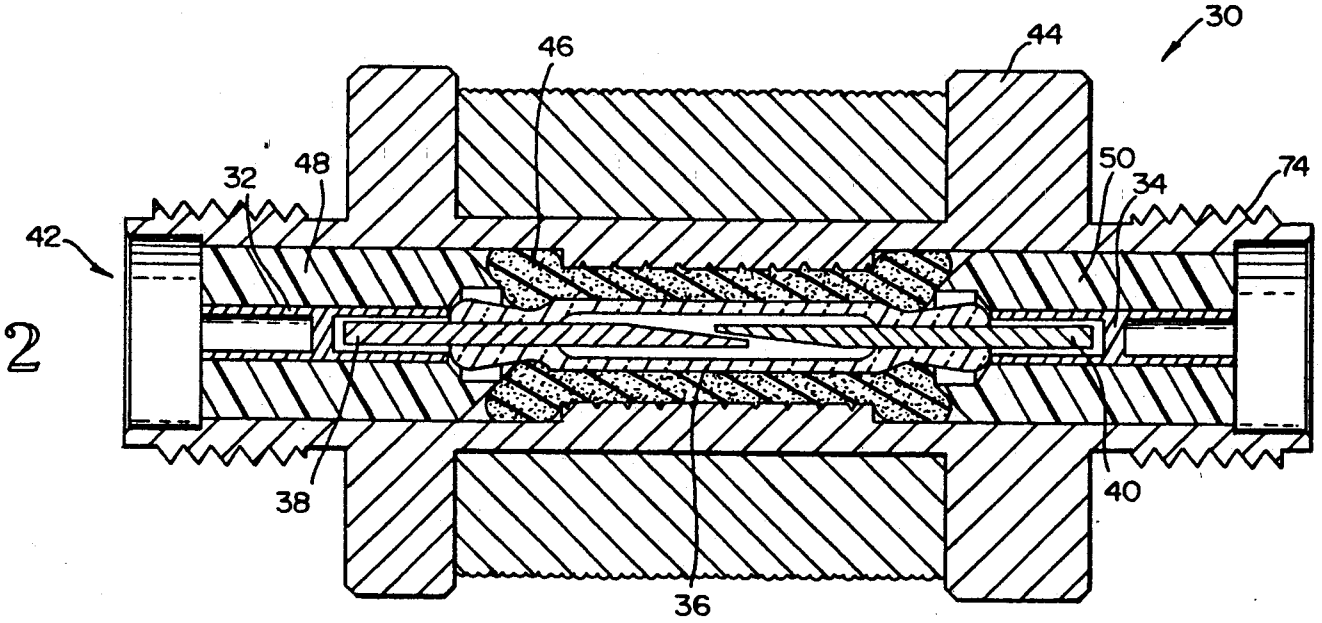
FIG. 2 is a cut-away view of a coaxial reverse power protection relay according to an embodiment of this invention.

FIG. 2 shows a cut-away view of a reverse power protection relay 30 according to an embodiment of this invention. The relay 30 is used in the signal path to an external connector of an RF instrument for protecting internal instrument circuitry from reverse power surges. When a reverse power surge having a voltage exceeding a prescribed voltage level is detected, control circuitry trips open the relay. As a result, the electrical signal path from the connector to the internal circuitry is open-circuited isolating the internal circuitry from the power surge. According to one embodiment, the relay 30 provides power isolation in the open-circuit position at greater than or equal to 14 dB for dc to 2.0 GHz.

Because the relay 30 is used in-line along an RF signal path, impedance matching to the rest of the signal path is important to avoid signal reflection and the accompanying signal degradation (i.e., an unflat RF characteristic). Accordingly, the relay 30 has an impedance substantially the same as the RF instrument signal path impedance. A typical RF signal path impedance used in practice is 50 ohms.

Because the relay 30 is part of an RF signal path, the relay also needs to provide other transmission line characteristics to assure the signal carried along an internal conductor is preserved. Transmission lines need to isolate the internal signal from external field radiation. In particular, a highly conductive ground is to be maintained about the center conductor especially in the presence of external fields. Susceptibility to RF field potentials is to be avoided. One of the inventions improvements is to reduce susceptibility.

Figure 3:
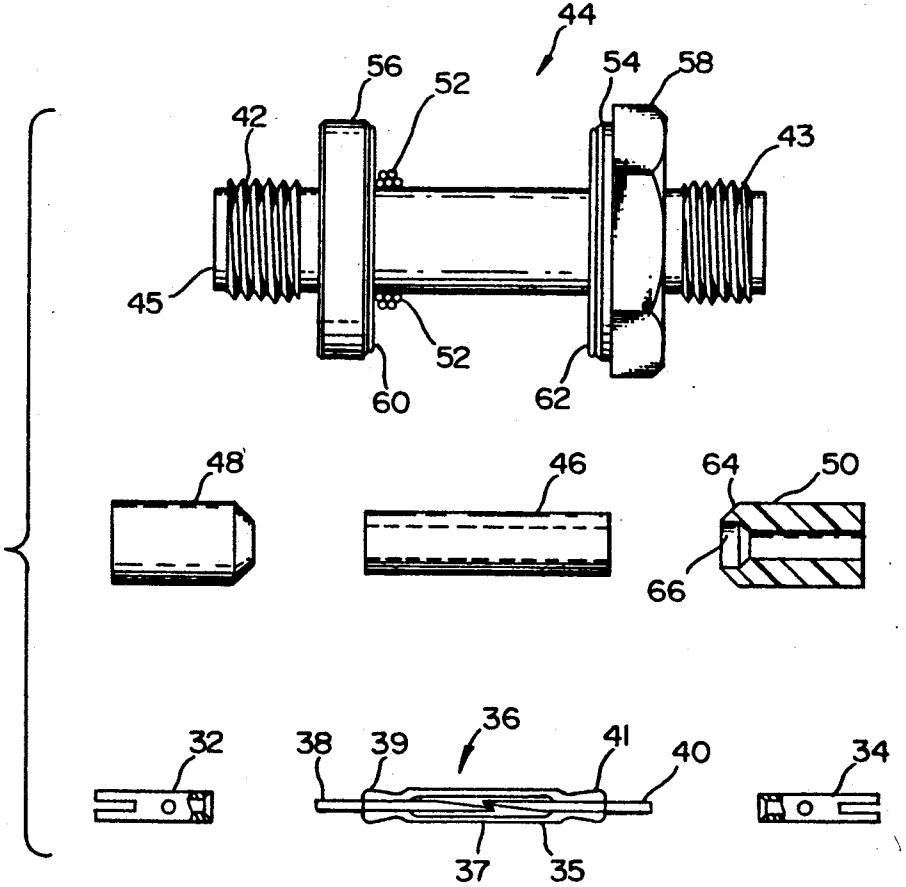
FIG. 3 is an exploded view of the relay of FIG. 2.

FIG. 3 shows an exploded view of the relay 30. As the relay 30 serves as a coaxial transmission line, there is an inner conductive signal path concentrically surrounded by an insulating area, which in turn is concentrically surrounded by an outer conductor. The inner conductor is formed by center contacts 32, 34 and reed switch 36 contacts 38, 40. In the closed position where contacts 38 and 40 are in physical communication, an electrical signal flows from an RF connector or connector mount at one end 42 to center contact 32, onto reed switch contact 38, then to reed switch contact 40, center contact 34 and another RF connector or connector mount. For an output signal path the signal starts within an RF instrument being generated at output amplifiers. From the amplifier, the signal travels through a connector mount into the relay at the central conductor, then to an RF connector and transmission line coupled to external circuitry.

STRUCTURAL CHARACTERISTICS

The relay 30 includes a body 44 having a central channel 45 into which central conductor components fit. The central conductor components include center contacts 32, 34 and reed switch contacts 38, 40. Enclosing the reed switch contacts 38, 40 is the insulative reed switch enclosure 35. Concentrically surrounding the center contacts 32, 34 are respective insulators 48, 50. The enclosure 35 and insulators 48, 50 serve as insulating dielectrics. Concentrically surrounding the reed switch enclosure 35 is a conductive elastomeric tube 46. Surrounding the tube 46 and insulators 48, 50 is the conductive body 44. The body 44 and tube 46 serve as the outer conductor.

Figure 4:
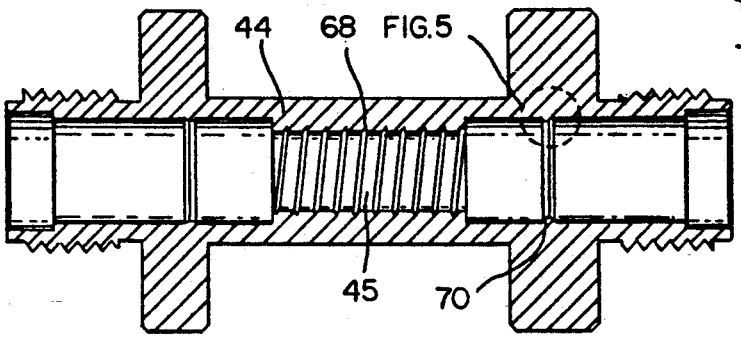
FIG. 4 is a cut-away view of the body portion of the relay of FIG. 2.

The body 44 is made from stainless steel machined into a generally cylindrical shape and having a central channel 45 (see FIG. 4). At one end 42 either plug or receptacle RF connectors also are formed. In the embodiment shown, plug connectors are formed at each end 42, 43. A coil is wound about the body 44 in a central region 54 between a first retaining wall 56 and a second retaining wall 58. One retaining wall 56 is a generally circular disk perpendicular to the channel 42 axis. For ease in installation and removal, the other retaining wall 58 is formed as a hexagonal nut. Insulating washers 60, 62 are positioned between the retaining walls 56, 58 to separate the stainless steel body 44 from the coil 52.

In one embodiment the coil 52 is AWG#26 wire rated at approximately 280 ohms and having a pull-in voltage of less than or equal to 3.0 volts and a release voltage of greater than or equal to 1.0 volts. Release time is less than or equal to 15 microseconds. Closed insertion loss between D.C. and 4.2 GHz is less than or equal to 0.8 dB. Closed return loss between D.C. and 3.0 GHz is greater than or equal to 20 dB, and between 3.0 and 4.2 GHz is greater than or equal to 16 dB.

Reed switch 36 includes contact wires 38, 40 enclosed along a partial length within a vacuum sealed glass vial 35. In the presence of a specified magnetic field, the contacts 38, 40 are pulled together within the vial 35 closing an electrical circuit. In the absence of the magnetic field the contacts 38, 40 are spaced apart so as to form an open circuit. Open isolation for DC to 2.0 GHz is greater than or equal to 14 dB. A difficulty with the use of reed switched in an RF signal path is the impedance mismatches that occur over the length of the vial 35. In particular, the reed switch 36 includes a high impedance area 37 along the central length and respective low impedance areas 39, 41 at the ends.

The leads 38, 40 of the reed switch 36 are trimmed and mate into respective center contacts 32, 34. The contacts 32, 34 are beryllium copper conductors having gold plating. Each contact is a cylindrical tube. A reed switch contact is soldered into one end of a center contact, while an external RF connector pin mates into the other end of the center contact. To provide secure mating over multiple connector installations, the center contacts 32, 34 have a slit through the outer wall at the end receiving the connector pin.

Upon assembly the reed switch 36 is surrounded by a conductive elastomeric tube 46, while the center contacts 32, 34 are surrounded by respective insulators 48, 50. In one embodiment the conductive elastomer is chomerics 1285, formed with Ag/Al balls in a silicone binder having a resistivity of less than 0.008 ohm-cm and 65+/−5 shore A. The tube walls are flexible, compressible and have a generally uniform thickness in a relaxed state.

Insulators 48, 50 are made from teflon and have chamfered edges for ease in installation. The insulators are hollow cylinders for receiving respective center contacts 32, 34. When installed one end of the insulator compresses the end of tube 46 to a fixed length. Each insulator 48, 50 also has a recessed area 66 which receives one end of reed switch 36. The reed switch contacts 38, 40 fit within the insulators 48, 50 and inner center contacts 32, 34.

Assembly

When assembling the relay 30, tube 46 is inserted into the body's channel 45. As shown in the FIG. 4 cut-away view of the body 44, the inner wall is threaded along its center length. This area receives the tube 46. The tube is flexible and compressible to conform to the walls of channel 45. As a result, threading 68 serves to hold the tube 46 in place during assembly.

When the reed switch 36 is inserted within the tube 46, the tubing is compressed and pushed outward at the ends. With each assembly the distance pushed may vary slightly. Such variation would cause a significant variation in the RF performance of the assembled connector. The insulators 48, 50 are installed within the body 44 against the tubing ends and against the reed switch ends. When the dielectric insulator is installed, the tubing ends are compressed axially inward giving the tube a fixed length for each assembly. Such length is prescribed to provide an area for balancing the high impedance section of the reed switch.

Figure 5:
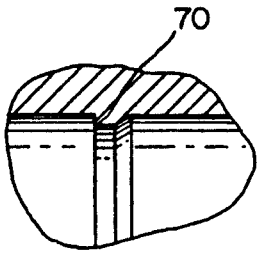
FIG. 5 is a detailed section of a portion of the body of FIG. 4.

Referring to FIGS. 4 and 5, the body 44 has a ridge 70. During assembly an insulator 50 is forced onto the ridge 70. The ridge 70 provides a secure grasp of the insulator 50.

Transmission Line Attributes

The relay 30 carries an RF signal during the closed state and thus, is to exhibit transmission line attributes. The relay 30 forms a transmission line structure and is impedance matched to a prescribed value (i.e., 50 ohms). A coaxial transmission line structure includes a center conductor and outer conductor separated by an insulating dielectric. The center conductor is formed by the center contacts 32, 34 and the reed switch contacts 38, 40. The insulating dielectrics are formed by insulators 48, 50, the reed switch vial 35 and the vacuum within the vial 35. Surrounding the insulators is the outer conductor—body 44 and tube 46. In operation, current flowing through the outer conductor flows along the inner surface of the body 44 adjacent to the insulators 48, 50 and along the inner surface of the tube 46 adjacent to the glass vial 35 of reed switch 36.

The center contacts 32, 34, insulators 48, 50 and body 44 are machined to standard sizes to achieve an impedance of approximately 50 ohms over the operating frequency range. The non-uniform thickness of the reed switch 36, however, requires compensation to achieve a standard 50 ohm impedance. With an outer conductor conforming to the reed switch vial 35 the center portion 37 is a relatively high impedance area of approximately 60 ohms and the end portions 39, 41 are relatively low impedance areas of approximately 40 ohms. These impedances balance to form an effective 50 ohm transmission line.

The elastomeric tube 46 provides the conformal outer conductor. As shown in FIG. 2, the tube walls are compressed along the length of reed switch 36 conforming to the shape of switch 36. When evaluating inner conductor size, dielectric thickness and outer conductor diameter according to the formula for impedance, the higher impedance portion 37 is compensated by the lower impedance portions 39, 41. As a result, the impedance balances to approximately 50 ohms along the length of the relay 30. Relay 30 thus has an impedance of 50 ohms matched to the other 50 ohm transmission line impedances in the RF instrument.

The relay 30 also reduces susceptibility to external RF fields. In one embodiment, the output signal passing through the center conductor ranges between +10 dBm and −120 dBm (dB relative to 1 milliwatt). For output signals at the lower end of the signal range (i.e., −120 dBm), external fields will have a larger dBc. To avoid susceptibility problems over the entire operating range, adequate RF isolation is needed. As discussed in the background section, prior relays were able to maintain RF isolation for external fields approaching −70 dBc. As 70 dBc is approached, however, the signal on the center conductor becomes susceptible to the external RF field. The relay body 44 of this invention provides RF isolation beyond the susceptible point (i.e., 70 dBc) of the prior art reverse power protection relays. During testing, the relay 30 achieved RF isolation for external fields beyond 100 dBc. Accordingly, the relay 30 provides RF isolation to the standard for an SMA connector.

Operation

The operation of relay 30 is described as used in an output signal path of an RF signal generator. During normal operation, a signal generator produces an output signal which travels from internal amplifier circuits to an RF connector mount at which relay 30 is positioned. The signal travels from the connector mount to center contact 32, then to reed switch contact 38. During normal operation, the coil 52 is energized causing reed switch 36 to be closed. As a result, the RF signal travels from reed switch contact 38 to reed switch contact 40, then to center contact 34 and an external RF connector mated to relay connector end 74.

When a reverse power surge is injected into the signal path somewhere outside the signal generator, the reverse signal travels into the relay 30 at contact 34 onto reed switch contact 40. As the reed switch 36 is normally closed, the signal travels across the reed switch 36 to contact 38, center contact 32 and back into the signal generator.

Figure 6:
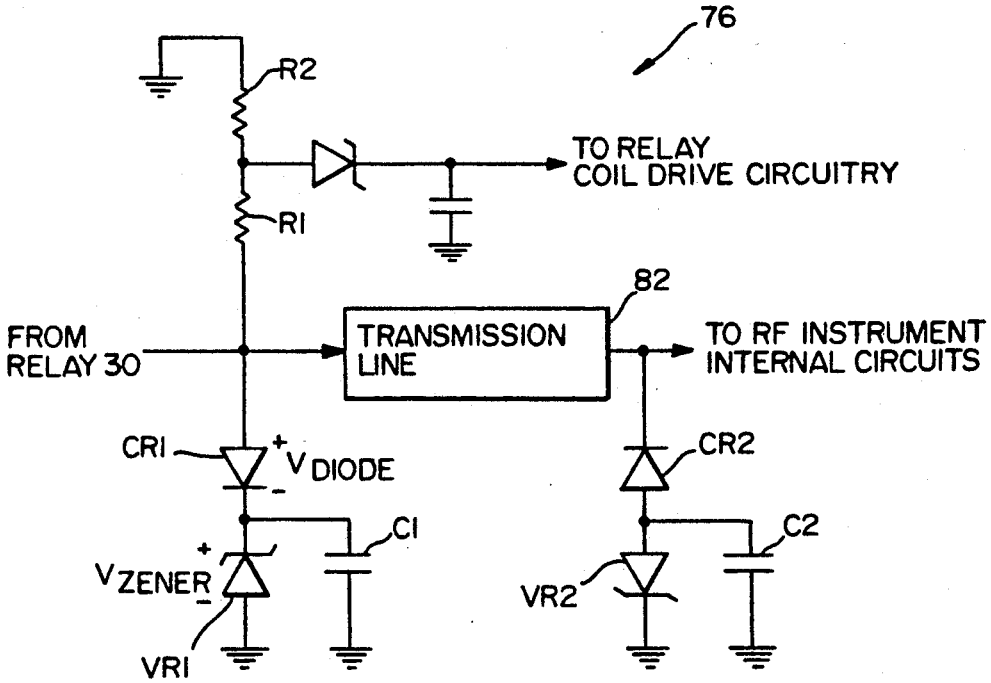
FIG. 6 is a partial circuit diagram of detection and control circuitry used for tripping the relay of FIG. 2.

FIG. 6 shows detection and control circuit 76 within the signal path between the relay 30 and an internal power amplifier or other sensitive internal circuitry of an RF instrument. The circuit 76 includes limiting diodes CR1 and CR2 which turn on when the peak RF voltage exceeds $V_{zener}+V_{diode}$, so as to clamp a reverse power signal voltage level exceeding a threshold level. $V_{zener}$ defines the threshold level. Large power surge signals, however, will have a substantial current which will burn through the diodes CR1, CR2 after a short period of time rendering the diodes damaged and exposing the internal electronics to the reverse power surge. Typically, larger diodes which could withstand the large power surges are not used because impedance matching could not be achieved over the desired operating frequency range. The detection circuit 76 is to detect the power surge and trip the relay 30 before the limiting diodes CR1, CR2 break down and before the expensive, sensitive internal circuitry is damaged.

The circuit 76 also includes a higher Z transmission line 82 which forms a low pass filter when combined with CR1, CR2. Over the operating frequency range the higher Z transmission line 82 balances CR1 and CR2 to a 50 ohm impedance.

A tap off the signal path detects voltage level and controls the relay drive current. When the detector circuit senses a voltage exceeding the threshold level, current to coil 52 is shut off, thereby de-energizing the coil and tripping open the reed switch 36. The detection, current shut-off and current drain-off operations occur in a fast time to avoid damage to the limiting diodes CR1, CR2 and the internal RF circuitry.

Concluding Remarks

Although a preferred embodiment of the invention has been described and illustrated, various alternatives, modifications and equivalents may be used. For example, although a 50 ohm embodiment is described, 70 ohm or other desirable impedances may be achieved while still practicing the inventions. Therefore, the foregoing description should not be taken as limiting the scope of the inventions which are defined by the appended claims.

What is claimed is:

1. A power surge protection relay for an RF signal path, comprising:

a switch having an electrically insulative tubular enclosure and a pair of conductive leads of predetermined length within the enclosure, the leads extending outwardly from axial ends of the enclosure, portions of the respective leads within the enclosure making physical contact in the presence of a specified magnetic field and being physically separate in the absence of the magnetic field;

a rigid conductive longitudinal body defining a central channel within which the switch is positioned, the body defining a first and second RF connector at respective ends of the channel;

a conductive elastomeric tube concentrically surrounding the switch within the channel;

a pair of conductive center contacts positioned within the channel, each one center contact concentrically surrounding a respectively outwardly extending lead at an axial end of the enclosure; and a pair of tubular dielectric means of predetermined length, each one dielectric means compressing ends of the elastomeric tube, abutting respective ends of the switch enclosure and concentrically surrounding a center contact and lead.

2. The relay of claim 1 in which the switch has a relatively high impedance area along a central portion of the enclosure and a relatively low impedance area along respective end portions; and wherein the elastomeric tube balances the impedance variations of the switch to achieve a generally uniform relay impedance by conforming to the outer shape of the central portion and end portions of the switch.

3. The relay of claim 1 in which the body and elastomeric tube provide RF isolation from external electromagnetic fields up to and beyond 70 dBc relative to signals travelling through the leads and center contacts.

4. The relay of claim 1 in which the body and elastomeric tube provide isolation from external electromagnetic fields up to and beyond 100 dBc relative to signals travelling through the leads and center contacts.

5. The relay of claim 1 in which each one dielectric means defines a recessed area at an end for receiving a portion of the enclosure.

6. The relay of claim 1 further comprising an electrical coil surrounding a portion of the body and radially spaced from the switch; the coil generating said specified magnetic field when energized.

7. The relay of claim 1 in which the body defines multiple ridges along the central channel at a position receiving the elastomeric tube for holding the tube in place.

8. The relay of claim 1 in which the body defines a ridge along the central channel at a position receiving an end portion of an insulating dielectric means for holding the dielectric means in place.

9. A power surge protection relay for an RF signal path, comprising:

a switch having an electrically insulative tubular enclosure and a pair of conductive leads of predetermined length within the enclosure, the leads extending outwardly from axial ends of the enclosure, portions of the respective leads within the enclosure making physical contact in the presence of a specified magnetic field and being physically separate in the absence of the magnetic field;

a rigid conductive longitudinal body defining a central channel within which the switch is positioned, the body defining a first and second RF connector at respective ends of the channel;

a conductive elastomeric tube concentrically surrounding the switch within the channel;

a pair of conductive center contacts positioned within the channel, each one center contact concentrically surrounding a respectively outwardly extending lead at an axial end of the enclosure; and a Pair of tubular dielectric means of predetermined length, each one dielectric means compressing ends of the elastomeric tube, abutting respective ends of the switch enclosure and concentrically surrounding a center contact and lead; and wherein the switch has a relatively high impedance area along a central portion of the enclosure and a relatively low impedance area along respective end portions; and wherein the elastomeric tube balances the impedance variations of the switch to achieve a generally uniform relay impedance by conforming to the outer shape of the central portion and end portions of the switch; and wherein the body and elastomeric tube provide isolation from external electromagnetic fields up to at least 100 dBc relative to signals travelling through the leads and center contacts.

10. The relay of claim 9 in which each one dielectric means defines a recessed area at an end for receiving a portion of the enclosure.

11. The relay of claim 10 further comprising an electrical coil surrounding a portion of the body and radially spaced from the switch; the coil generating said specified magnetic field when energized.

12. The relay of claim 11 in which the body defines multiple ridges along the central channel at a position receiving the elastomeric tube for holding the tube in place.

13. The relay of claim 12 in which the body defines a ridge along the central channel at a position receiving an end portion of an insulating dielectric means for holding the dielectric means in place.

* * * * *